US005362176A

United States Patent [19]

Sovik

[11] Patent Number: 5,362,176

[45] Date of Patent: Nov. 8, 1994

[54] ROAD CONSTRUCTION APPARATUS AND METHODS

[75] Inventor: Robert A. Sovik, Clifton Park, N.Y.

[73] Assignee: AW-2R, Inc., Clifton Park, N.Y.

[21] Appl. No.: 3,003

[22] Filed: Jan. 11, 1993

[51] Int. Cl.[5] ..... E01C 19/00

[52] U.S. Cl. ..... 404/72; 404/84.1; 404/84.5

[58] Field of Search ..... 404/84.05, 84.1, 84.2, 404/84.5, 72

[56] References Cited

U.S. PATENT DOCUMENTS

| | | | |
|---|---|---|---|
| 3,917,015 | 11/1975 | Hawkins | 180/6.48 |
| 4,823,366 | 4/1989 | Williams | 377/2 |
| 4,943,119 | 7/1990 | Zarniko et al. | 299/1 |
| 4,948,292 | 8/1990 | Haven et al. | 404/84 |
| 4,988,233 | 1/1991 | Kasler et al. | 404/108 |
| 5,009,544 | 4/1991 | Chaize | 404/72 |
| 5,201,604 | 4/1993 | Ferguson et al. | 404/110 |
| 5,309,407 | 5/1994 | Sehr et al. | 367/96 |

FOREIGN PATENT DOCUMENTS

| | | | |
|---|---|---|---|
| 2443012 | 6/1976 | Germany | 404/84.05 |
| 9208847 | 5/1992 | WIPO | 404/84.1 |

*Primary Examiner*—Mark Rosenbaum
*Assistant Examiner*—John M. Husar
*Attorney, Agent, or Firm*—Joseph V. Claeys

[57] ABSTRACT

Discloses methods and apparatus for use with road construction equipment and apparatus (such as, for example, pavers, road millers and cutters, graders, and the like) including sensing apparatus for sensing and determining a selected edge of an existing pavement structure and controlling the road construction equipment or apparatus (or an element of such equipment or apparatus) in a desired manner with respect to such selected edge.

14 Claims, 4 Drawing Sheets

ROAD CONSTRUCTION APPARATUS AND METHODS

BACKGROUND

The present invention relates generally to the field of road construction, including the paving of surfaces, such as roads and the like with road forming mixtures such as asphalt and similar materials, and more particularly to new and improved methods and sensing apparatus for use with road construction equipment wherever the road construction equipment or an element of such road construction equipment is desired to be maintained in a constant relationship to an edge. The road construction may be employed for performing various functions such as paving, cutting and milling, grading, and the laying of such road forming mixtures in a desired location with respect to an edge such as, for example, a curb, the vertical cut edge or the sloping edge of an existing pavement structure, or with respect to the vertical edges of trenches cut in such pavement structures, and similar situations.

Although the methods and apparatus of the present invention are applicable to any situation wherein it is desired to position the road construction equipment or apparatus (or an element of such construction equipment or apparatus, such as the spreading element of a paver, the cutter element of a pavement milling apparatus, or the like) at a desired location with respect to a selected edge of a pavement structure (or in maintaining it in a constant relationship to an edge), such as in laying a new lane of pavement, laying a pavement extension, back-filling a pavement structure, cutting trenches, milling a pavement structure, filling cut-out trenches, and the like, it is particularly useful for consistently producing high density, long-lasting longitudinal joints between a first cold mat section of compacted paving material and a second mat section of fresh paving material, and will be described in detail in that connection. Further, the invention provides new and improved methods and sensing apparatus for increasing the accuracy of laying fresh paving material parallel to, and contiguous with, an edge of a pavement structure.

In the specification and claims hereof, the following terms will be used from time to time and their respective meanings are set forth below for convenient reference:

(1) The term "edge line" means an edge or reference the location of which is to be sensed or determined and includes, but is not limited to, an edge of an existing pavement structure, such as a curb, one or both edges of a trench, the edge of a reference beam or wire, the top inboard edge of a previously laid, compacted and rolled first mat section of cold paving material which forms the longitudinal joint with the joint edge of the second mat section of freshly laid hot paving material.

(2) The term "joint edge" means the edge of fresh paving material which is to be laid at a desired location with respect a selected edge line.

(3) The term "joint end" means the end of a machine element, such as the end of the main screed of a paver, or the end of the extendible screed section of a paver, which is disposed alongside the longitudinal joint during the paving operation.

(4) The term "edge region" means the region which commences at the edge line of a rolled and compacted pavement structure and extends downward from such edge line toward the base or substrate upon which the paving material is laid.

(5) The term "road construction equipment" is used in its broadest sense and is intended to include any road construction equipment or apparatus used or useful in performing the various functions desired in the construction of roadways, such as for example, pavers, paver/finishers, pavement cutting and milling apparatus, and related equipment and apparatus which in operation is desired to be maintained in a constant relationship to a selected reference or edge.

The present invention may be employed with the well known over-lap paving technique or the new and improved paving techniques of my previous U.S. Pat. Nos. 5,051,026 and 5,088,854, and the continuation-in-part application Ser. No. 762,925, now U.S. Pat. No. 5,213,442 Filed Sep. 19, 1991, wherein there are described and claimed new and improved paving methods and apparatus. The descriptions of my foregoing U.S. Pat. Nos. 5,051,026 and 5,088,854, and application Ser. No. 762,925 now U.S. Pat. No. 5,213,442 are incorporated herein by reference.

For example, in accordance with my U.S. Pat. No. 5,088,854, methods and apparatus are provided for producing improved high density , long-life longitudinal joints between a first previously laid mat section of cold paving material and a second mat section of fresh paving material. Briefly, as described in such patent the second mat section of fresh paving material is provided with a quantity of additional fresh paving material formed into a shaped charge of predetermined profile and disposed near the joint edge of the second mat section. The quantity of additional paving material contained in the shaped charge and the configuration of the shaped charge are made such that after rolling, the lateral and transverse compaction forces generated, force sufficient fresh paving material into the joint region to bring the density of the paving material in such joint region to substantially the specified density and substantially the same as that of the first and second mat sections. That is, the resulting density of the entire paved area comprising the two mat sections and the longitudinal joint therebetween is substantially uniform.

As described in my foregoing U.S. Pat. No. 5,088,854, this is accomplished by providing the spreading element of the paver machine, such as the main screed section or an extendible screed/wing section, with a suitable channel or cavity formed in the spreading element which provides for the laying of a region of additional paving material near the joint edge of the second mat section and for forming this additional paving material into a shaped charge having a desired configuration or profile. Extendible screed/wing sections are sometimes also referred to in the art as "end-gates". In known paver machines, the spreading element may include a main screed section and two independent, hydraulically operated, laterally extendible screed sections, one mounted on each end, either in front or in back of the main screed section. Accordingly, the channel or cavity may be formed at one end of the main screed section, or at one end of the extendible screed section. The end of the spreading element in which the shaped charge channel or cavity is formed is the end which will be adjacent the edge line of the first cold mat section when the paver is moved longitudinally alongside the first cold mat section. That is, the cavity will be formed in the joint end of the main screed section, or in the joint end of the extendible screed section.

Briefly, therefore, the requirements for consistently producing such a long-life longitudinal joint are:

1. Laying the second mat section of fresh paving material parallel to, and contiguous with, the edge of the first mat section, and
2. Providing the second mat section of fresh paving material with sufficient additional fresh paving material to insure that design density is obtained at the longitudinal joint region.

Accordingly, in producing such a desired long-life longitudinal joint it is important that the edge of the second mat section of fresh paving material be consistently laid at a selected location with respect to the edge of the first mat section of cold paving material. That is, the joint edge of the second mat section of fresh paving material must be laid so that it has a selected amount of overlap, or so that it is parallel to, and contiguous with, the edge line of the first cold mat section of paving material and in the absence of any overlap.

In the present common over-lap paving practice, the paver finisher machine laying down the second mat of fresh paving material is run about three inches over the edge line of the first mat section of cold paving material to assure that before rolling the joint edge of the second mat section will be contiguous with the edge line of the first cold mat section. For example, it is well known that if the fresh paving material is permitted to lie on top of the first mat section of cold, compacted and rolled paving material, when a conventional multi-wheel roller is run along the joint region, the compacted material of the first mat section supporting one side of the roller will prevent effective compaction of the joint. Accordingly, this fresh paving material should be removed from the top of the first cold mat section before commencing the rolling of the second mat section and the joint region. Removal of this overlap can be accomplished by a workman manually brooming or scraping off the material, providing a scraper bar that is attached to the trailing end of the paver machine, or providing a rotatable brush means attached to the trailing end of the paver machine.

SUMMARY

It is a primary object of this invention to provide a system for maintaining an element of a piece of road construction equipment in a constant relationship to a selected reference or edge.

It is another object of this invention to provide sensing apparatus and methods for determining the edge line of the first cold mat section and controlling the position of the spreading element of the paver machine in accordance with such determination to assure that the joint edge of the second mat section of freshly laid paving material is contiguous with such edge line and, preferably in the absence of any overlap or gap with respect to such edge line.

It is still another object of the present invention to determine the edge line of the first mat section of cold paving material and to guide or steer the paver machine in accordance with such determination to assure that the joint edge of the second mat section of fresh paving material is placed at a desired location with respect to the edge line of the first cold mat section.

It is yet another object of the present invention to determine the edge line of the first mat section of cold paving material and to control the position of the extendible screed section of the paver machine in accordance with such determination to assure that the joint edge of the second mat section of fresh paving material is placed at a desired location with respect to the edge line of the first cold mat section.

Briefly stated, in accordance with one aspect of the invention there is provided a system for continually sensing and determining the location of a selected edge line and controlling the position of a piece of road construction equipment or apparatus, or controlling the position of an element of such road construction equipment or apparatus with respect to such selected edge line in a desired manner.

In accordance with another aspect of the invention there is provided a system for consistently producing improved longitudinal paving joints between the edge region of a first cold mat section of paving material which has been previously laid on a selected substrate and compacted , and the joint edge of a second mat section of fresh paving material to be laid on the substrate adjacent the first cold mat section by the spreading element of a paver machine, which paver machine is adapted for movement longitudinally alongside the first cold mat section. The system includes sensing means for generating an electrical signal representative of the location of the edge line of the first cold mat section. The system also includes a control means, which may include electrical signal processing means and power means, which is responsive to the signal from the sensing means for causing movement of the spreading element so as to align the joint end of the spreading element with respect to the edge line of the first cold mat section to cause the joint edge of the second mat section of fresh paving material to be placed at a desired location with respect to the edge line of the first cold mat section. The movement of the spreader element may be provided by controlling the steering of the paver machine, or by moving the laterally extendible screed section of the paver machine. The sensing means continually determines the edge line of the existing pavement structure.

In accordance with another aspect of this invention there is provided a new method for consistently producing improved longitudinal paving joints between first and second mat sections of paving material. The method includes laying a first mat section of paving material on a selected substrate so that the first mat section exhibits longitudinally extending, substantially parallel inboard and outboard edges. The paving material of the first mat section is compacted to achieve a predetermined density in the first mat section. The compacting results also in the squeezing of the unsupported inboard edge of the first mat section to form an edge region which angles downward from the edge line of the compacted first cold mat section to the substrate. In accordance with the invention the location of the edge line of the first mat section is continuously determined and such determination is utilized to control the laying of a second mat section of fresh paving material adjacent the first mat section in a controlled manner so that the inboard edge (i.e. the joint edge ) of the second mat section of fresh paving material is placed at a desired location with respect to the edge line of the first cold mat section, preferably parallel to, and contiguous with, the edge line of the compacted first mat section.

BRIEF DESCRIPTION OF THE DRAWINGS

The novel features which I believe characteristic of the invention are set forth with particularity in the appended claims. The invention itself, however, together with further objects and advantages thereof, may best be understood by reference to the following detailed description together with reference to the accompanying drawings wherein:

DETAILED DESCRIPTION

Figure 1:
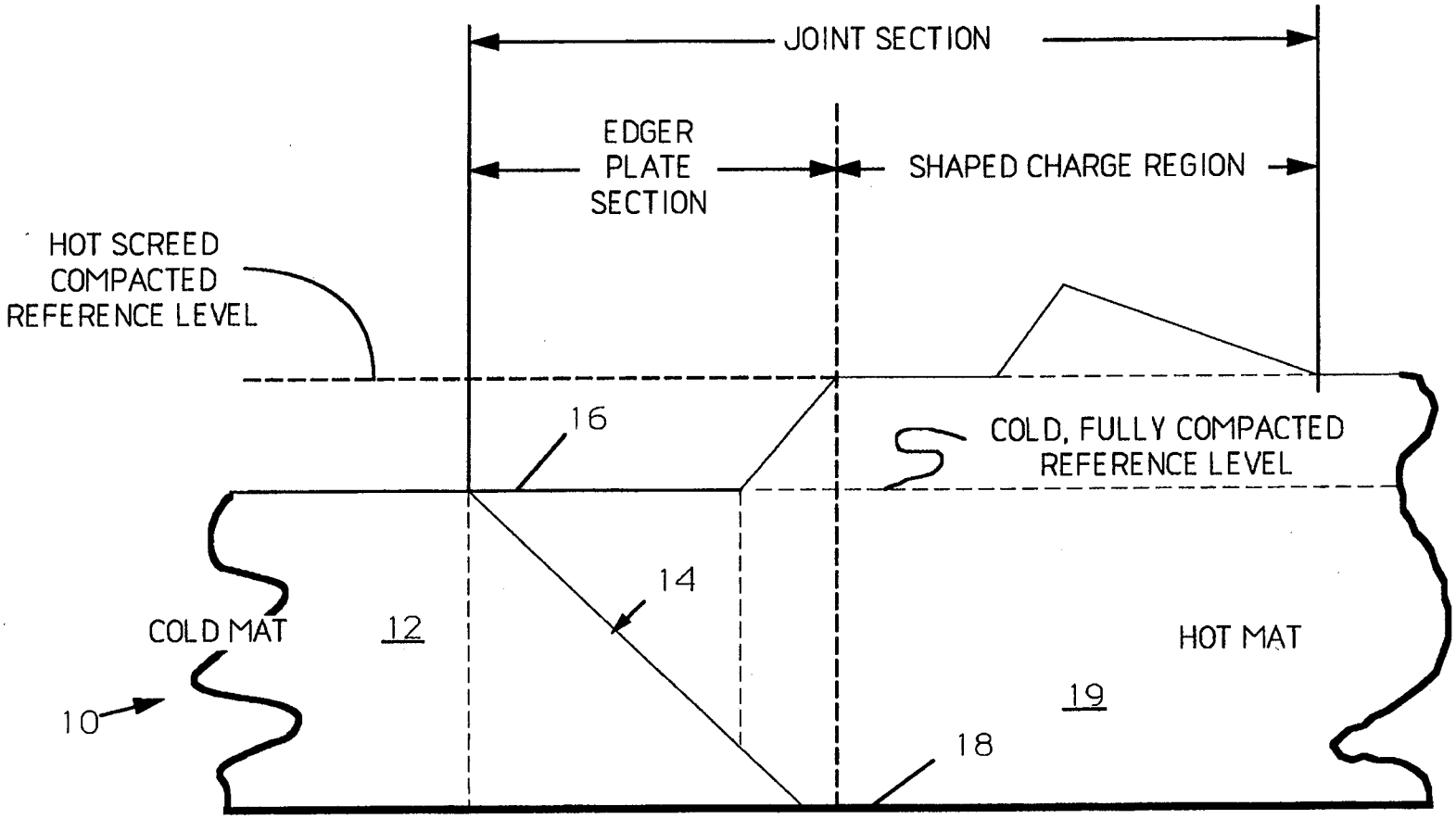
FIG. 1 is a diagrammatic view of a portion of a cold mat section of previously laid and compacted paving material, together with the adjacent mat of fresh paving material and the profile of the shaped charge region of additional fresh paving material formed thereon.

Referring now to the drawings, there is shown in FIG. 1 a cold mat section 10 which includes a region 12 of previously compacted paving material which terminates in an edge region 14. Edge region 14 extends at a downward angle from the edge line 16 to the surface of the base or substrate 18 upon which the paving material has been placed. In completing the paving, a second mat section of fresh, paving material 19 is laid parallel with the cold mat section 10 and so that the joint edge of the second mat section of fresh, paving material is placed in a desired location with respect to the edge line 16. That is, the fresh paving material is placed either with a desired overlap with respect to the edge line or contiguous with such edge line.

The second mat section of fresh, paving material may be laid with any of the well known spreader or paver finisher machines and using the over-lap technique or the paving techniques of U.S. Pat. Nos. 5,051,026, or 5,088,854 as illustrated in FIG. 1 which provides for the placement of additional paving material of either predetermined profile (U.S. Pat. No. 5,088,854) or of predetermined density (U.S. Pat. No. 5,051,026) at the joint region.

Figure 2:
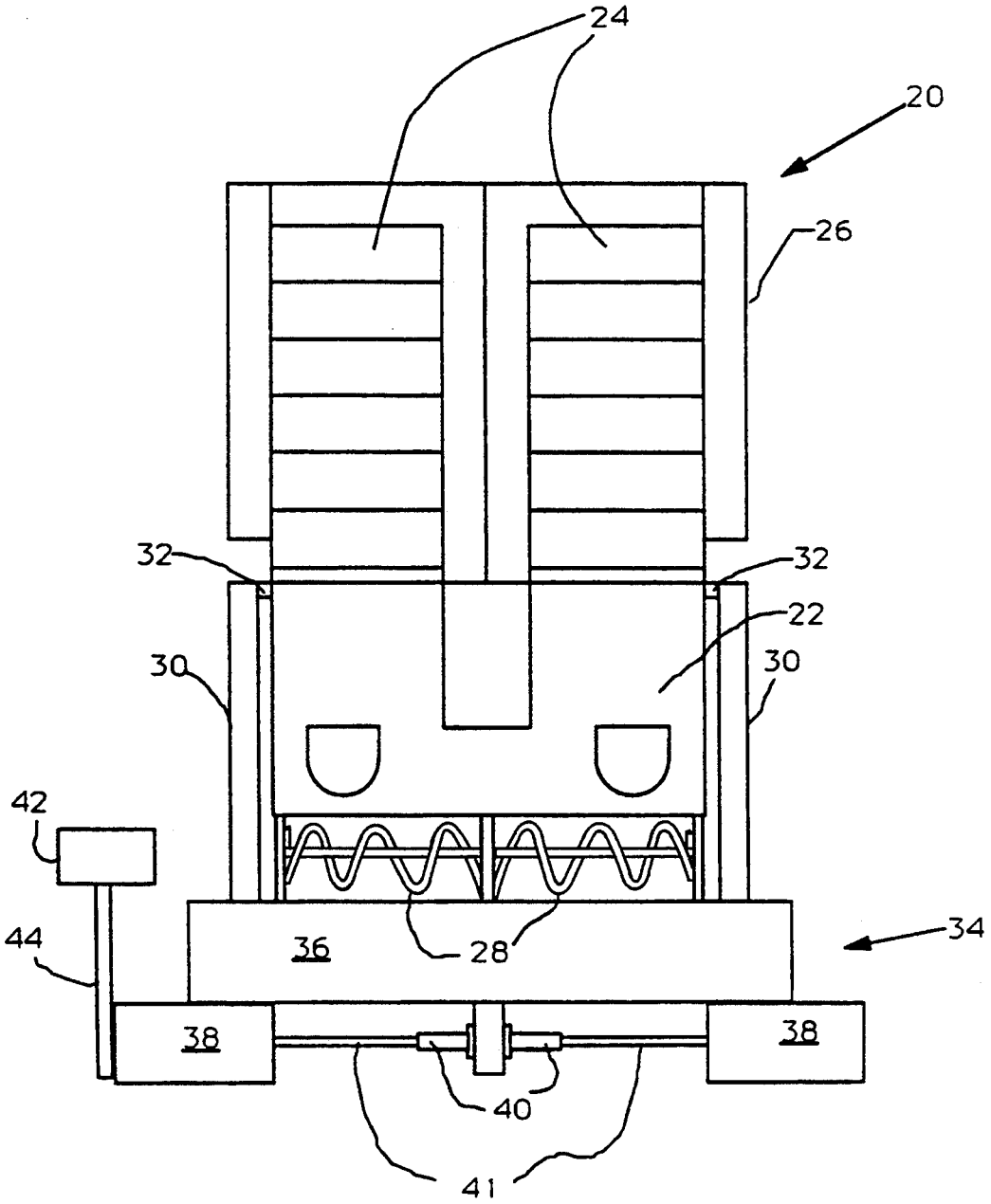
FIG. 2 is a diagrammatic top plan view of a typical bituminous paver machine incorporating the present invention and having an extendible screed assembly with the screed extension being shown partially extended.

In FIG. 2 there is illustrated a diagrammatic top plan view of a typical bituminous paver machine incorporating the present invention and having an extendible screed assembly with the screed extensions being shown partially extended. Because such paver machines are well known in the art, details of the complete machine are not shown. As illustrated in FIG. 2 a typical paver machine 20 includes a tractor unit 22 having slat conveyors 24 to carry the paving mixture from the hopper 26 rearward to the cross-feed augers 28. The forward ends of a pair of screed side arms 30 are journaled at 32 to the sides of the tractor unit 22. The screed side arms 30 extend rearward and are connected at their rear ends to an extendible screed assembly, generally designated at 34, disposed transversely across the rear of tractor unit 22.

The screed assembly 34 includes a main screed section 36 and two independent, hydraulically operated, laterally extendible screed sections 38 (and may also include strike-off sections), one located on each end of the main screed section 36. The extendible screed sections 38 are illustrated as being located in back of the main screed section 36, however, in some machines such extendible screed sections are located in front of the main screed section. The extendible screed sections 38 act as part of the paver machine and the position thereof can be controlled by suitable well known hydraulic cylinders 40 which are attached to the main screed section 36. The piston rods 41 of the hydraulic cylinders 40 are connected to the extendible screed sections 38 so as to increase or decrease the width of the distribution chamber as the paving machine is operating so that varying widths on each side of the paving machine may be paved. Such extendible screed paver machines are also provided with electrical switching control consoles on each side of the machine to provide for separate finger-tip, electrical switch control of the extendable screed sections 38.

The paver 20 is provided with an edge sensing means 42 in accordance with the present invention. The edge sensing means 42 is shown as being mounted to the extendible screed extension 38 by a suitable bracket 44. The edge sensing means 42 continuously determines the edge line 16 of the cold mat section 10 and is arranged and constructed to provide an appropriate signal which is employed in a desired manner to assure that the second mat section of fresh paving material is arranged to be laid in accordance with such determination so that such joint edge of the second mat section is placed in a desired location with respect to the edge line 16. For example, the joint edge of the second mat section of fresh paving material may be placed parallel to, and with a predetermined over-lap of the edge line 16, or it may be placed parallel to, and contiguous with, the edge line 16 of the cold mat section 10. This is accomplished by controlling (steering) the paver in accordance with the edge line determination to control the position of the joint end of the spreading element, or by controlling the position of the joint end of the extendible screed section of the paver in accordance with such determination, to assure that the joint end of the spreading element is maintained in proper alignment with the edge line 16 of the compacted cold mat section.

Although as illustrated in FIG. 2, the foregoing extendible screed paver machines are provided with two independent, hydraulically operated, laterally extendible screed sections 38 one at each end of the main screed section 36, for simplicity, the further description of the invention will be made with reference to the positioning or repositioning of only one of the extendible screed sections 38, since both are identical in construction and operation, and also since in the present description the longitudinal joint is produced at only one side of the paver, the other side of the paver during such joint making operation being associated with the outboard (shoulder, or curb side) portion of the road.

In most instances it will be found that the edge line 16 of the cold mat is not in a straight line. That is, the edge line 16 of the compacted cold mat section 10 will weave due to several factors, which include, but are not limited to the uniformity of the surface of the substrate upon which the paving material has been laid, and the rolling pattern employed. In present practice, the paver machine operator attempts to compensate for the weave of the edge line 16 by manually steering the paver machine, or moving the extendible screed section during the paving operation to position the spreading element ( the main screed or the extendible screed section as the case may be) so as to maintain a desired uniform overlap of the edge line 16, which may be about three inches, for example. This presents another problem, since after the second mat section of fresh paving material has been laid, the actual location of the edge line 16 can no longer be seen by the operator. With such an overlap type of paving technique the actual overlap provided in practice is merely an approximation based upon the accumulated experience, skill, and judgement, of the particular operator, since the operator has no real visible reference to follow. Accordingly, even using such an overlap paving technique, there is no assurance that sufficient fresh paving material will be placed parallel to, and contiguous with, the edge region of the cold mat section to produce a desired high density, long-life longitudinal paving joint.

In accordance with the present invention, the foregoing prior art problems and deficiencies are overcome, since the location of the edge line 16 of the cold mat section is continuously determined and referenced to the position of the joint end of the spreading element by a suitable sensing means and control means. The information developed by the sensing and control means may be utilized in any known manner to assure the proper placement of the fresh paving material. For example, the information may be utilized to provide the operator with a visual display showing the position of the joint end of the spreading element with respect to the edge line 16 so that the operator can move the extendible screed section 38 so as to bring the joint end of the spreading element into the desired alignment with the edge line 16 and assure that the joint edge of the second mat of fresh paving material is properly placed to assure a high density, long-life longitudinal joint. Alternatively, the operator may utilize the displayed information to steer the entire paver machine to achieve such alignment.

Preferably, the control signal produced is utilized to automatically control the movement of the joint end of the spreading element to continuously maintain the desired alignment. Again, the control signal may be employed to automatically guide or steer the paver machine itself, or the control signal may be employed to automatically control the movement (inward or outward) of the power extendible screed sections.

The ability to follow the edge line of the compacted cold mat presents two problems :

1. The edge region 14 of the compacted cold mat section 10 has a long term change or weave as described above with respect to FIG. 1, and
2. The edge line 16 of the compacted cold mat section 10 is not uniform. Short term protrusions and indentations occur at the depending edge region 14. The magnitude of these short term irregularities are determined by such things as the size of the aggregate, and the type of mix.

I have discovered that in order to place the desired amount of fresh paving material at the joint when laying the second mat section of fresh paving material to consistently produce a high density, long-life longitudinal joint, it is necessary to follow both the short term and the long term changes of the edge region 14. More specifically, it is advisable to follow the long term change using the centerline (true location) of the short term center of mass as the reference. This dictates that the short term irregularities of the edge region 14 be eliminated or substantially reduced. Conveniently this can be accomplished by averaging the protrusions and indentations and determining the centerline of the edge region 14 of the compacted cold mat section 10.

Accordingly, in accordance with this invention, the proper alignment for the placement of the second mat section of fresh paving material with respect to the edge line 16 of the compacted cold mat section 10 to assure that the joint edge of the second mat section will be placed in a desired location with respect to the edge line 16, is provided by continuously sensing the edge region 14 and determining the location of the edge line 16 with respect to the joint end of the spreading element, (e.g. the joint end of the extendible screed section 38, or the joint end of the main screed section 36) during operation of the paver machine and producing a control signal for controlling the position of the joint end of such spreading element by either controlling (steering) the paver machine itself in accordance with such control signal, or controlling the position of the joint end of the extendible screed section 38. That is, in accordance with this invention an end of the machine element is maintained in a constant relationship to an edge.

Any suitable contacting or non-contacting type sensing means may be employed with the present invention which is capable of determining the selected edge, such as the edge line 16. For example, the sensor device of sensing means 42 may be of the mechanical contacting type wherein a roller , ski, or the like is moved over the surface of the edge region 14. Other known sensing systems, such as the ultrasonic type, laser type, inductive type, capacitance type, or any other suitable type of sensing means or system, or combinations thereof may also be employed with the present invention, so long as such system can continually sense and determine the location of the reference, such as an edge line.

A capacitance type sensing system is preferred, since such a capacitance type sensing system is noncontacting and is capable of sensing and determining the center of mass of the material, such as the center of mass of the paving material of the sloping edge of a previously laid, rolled and compacted mat of paving material. In operation the capacitance sensing system is disposed proximate the selected reference or edge and out of contact with it.

In a typical mechanical, contacting type sensor device, for example, a wheel, roller, ski, or the like is mounted on the paver machine and is arranged and constructed to ride on the sloping edge region 14 to produce an electrical signal representative of the location of the edge line 16. For example, a suitable mechanical contact sensing device may comprise a spring-loaded arm provided with electrical switches at each end of the limit of travel. The signals from the mechanical contact sensing device are then utilized to bring the joint end of the spreading element to the desired location with respect to the edge line 16.

Figure 3:
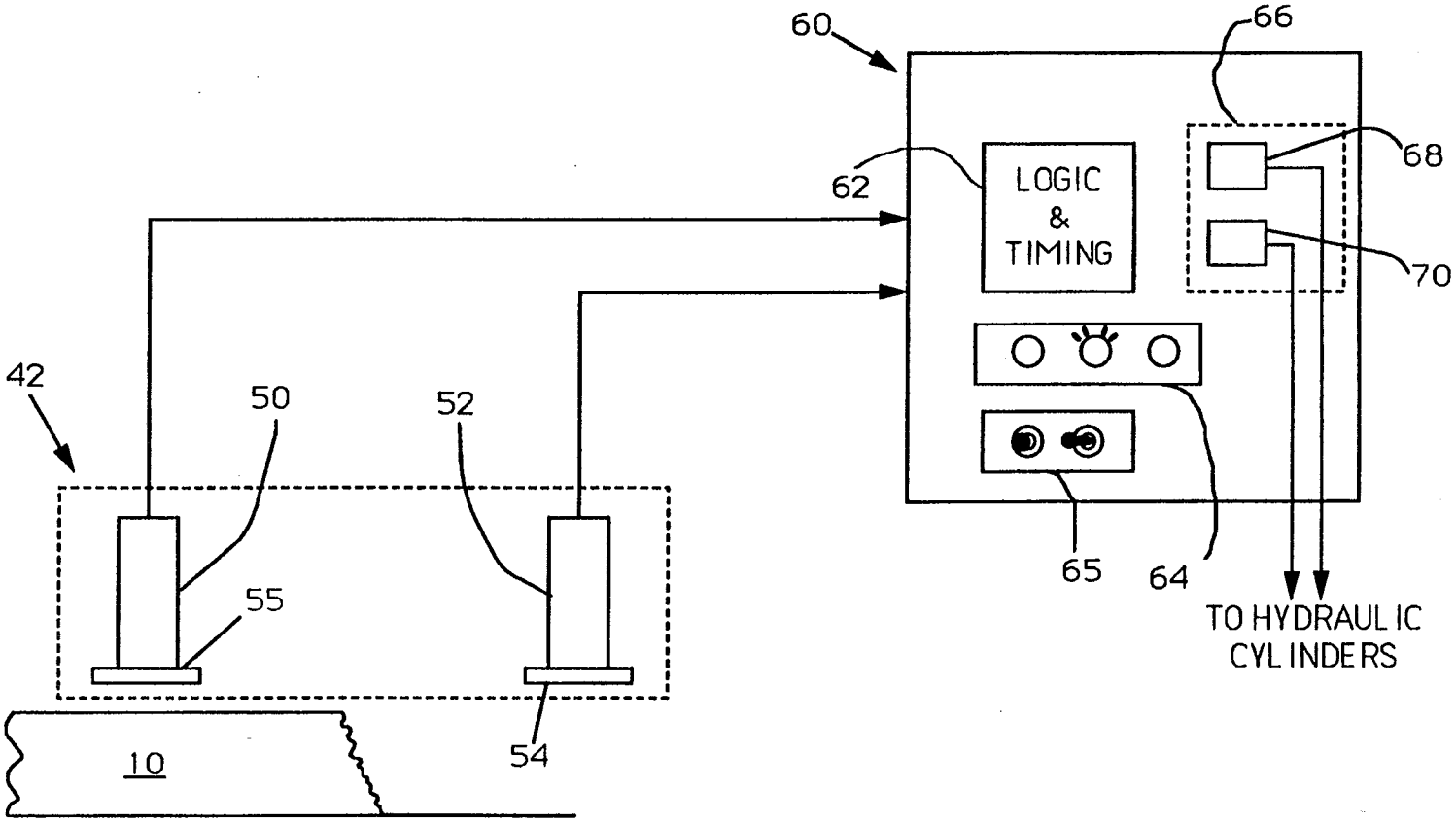
FIG. 3 illustrates a simplified schematic electrical block diagram for sensing and controlling a lateral deviation of the joint end of the paver spreading element, such as the extendible screed section, in accordance with one embodiment of this invention.
Figure 4:
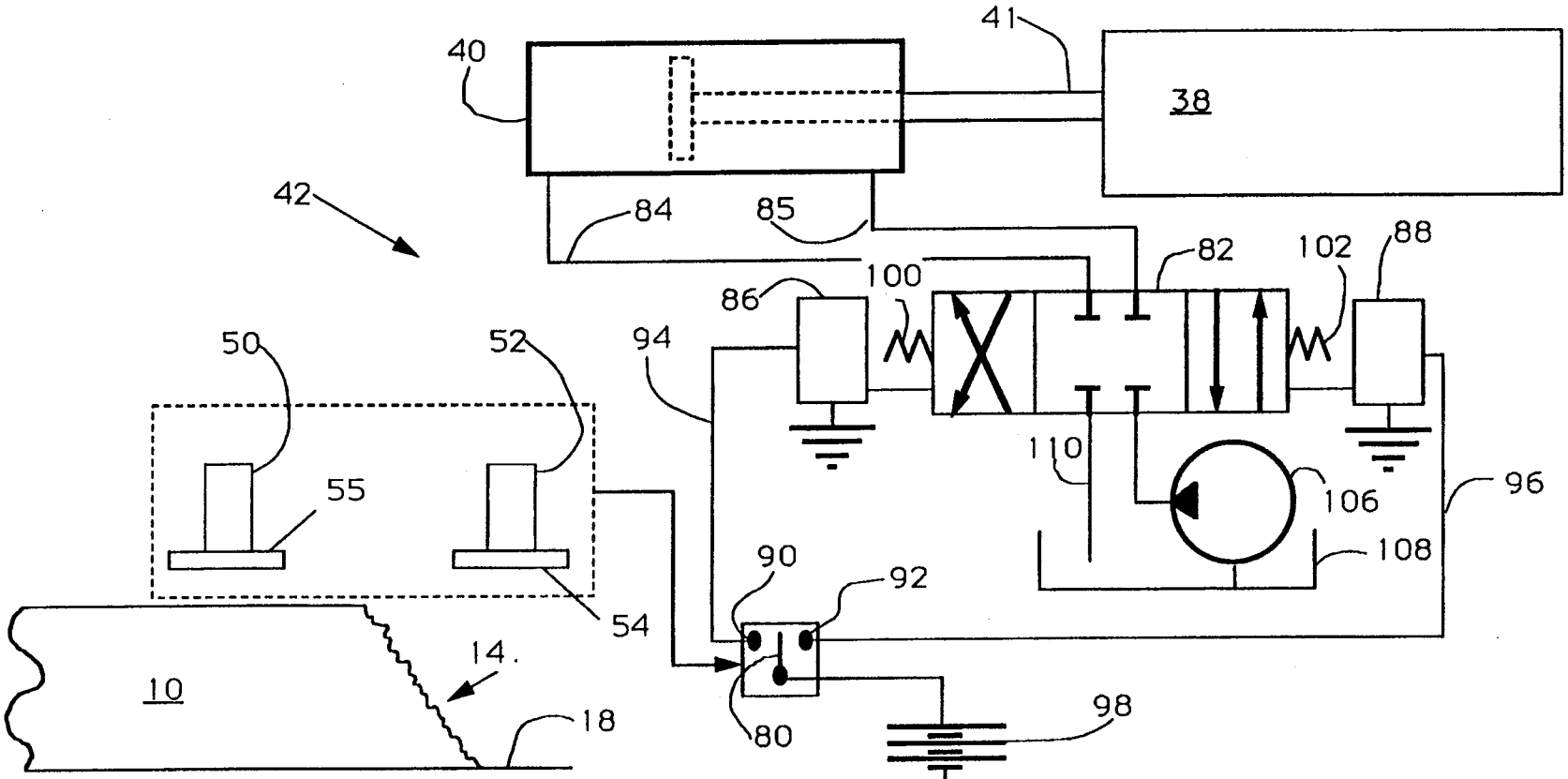
FIG. 4 illustrates a simplified schematic/hydraulic block diagram showing a suitable arrangement for sensing and controlling a lateral deviation of the joint end of the paver machine spreading element (e.g. extendible screed section) from a desired reference in accordance with this invention.

Similarly, in a typical non-contacting type of sensing means or system, the sensing means 42 is mounted on the paver machine as illustrated in FIG. 2 and arranged and constructed to move across, or scan the edge region 14 of the compacted cold mat section 10 as the paver machine is moved alongside the cold mat section for producing a signal representative of the location of edge line 16. This signal from the sensing means 42 is then suitably processed in any suitable known manner ! Such as shown in FIG. 3, and FIG. 4 for example) to provide a control signal indicating the position of the joint end of the spreading element, such as the joint end of the main screed section 36 or the joint end of the extendible screed section 38 with respect to the edge line 16 of the compacted cold mat section 10. The control signal is then utilized to position the end of the spreading element (e.g. the end of the extendible screed section 38) with respect to the sensed edge line 16.

Since known paver machines are already provided with electrical control consoles to provide for operator control of the steering and/or control of the position of the extendible screed sections 38, this control signal may be readily incorporated with the existing paver machine control system so as to automatically steer the paver or reposition the extendible screed sections 38 in response to such signal. For example, the control signal may be employed as illustrated in FIG. 3 to cause energization of an appropriate one of the hydraulic cylinders of the paver machine to accomplish such result. Alternatively, the control signal may be utilized to actuate the existing steering control system of the road construction equipment to control the steering or otherwise guide the paver machine itself so as to reposition the paver machine in response to the control signal so that the joint end of the main screed section 36 or the joint end of the extendible screed section 38 will be placed in the desired position with respect to the edge line 16. That is, the control signal may be employed to actuate the hydraulic cylinders to control the positioning of the extendible screed sections, or to actuate the hydraulic cylinders which control the steering of the paver, or other piece of road construction equipment.

In accordance with the present invention, a suitable edge line sensing mean 42 is provided for determining the edge line 16 of the cold mat 10 and is arranged and constructed to provide an appropriate signal which may be employed in a desired manner to either control the position of the extendible screed section 38, or to manually or automatically guide, or steer the entire paver machine to assure that the joint edge of the second mat section of fresh paving material will be properly positioned with respect to the edge line 16 of the cold mat 10. Conveniently, the signal from the edge line sensing means 42 may be incorporated with the existing electrical control system of the paver machine to provide for automatic steering control of the paver machine or automatic positioning control of the extendible screed sections 38.

In addition, such signal may be employed to produce a suitable visual display such as by a meter, or a plurality of lamps, light emitting diode (LED) devices, or other suitable visual display devices which when energized in response to such signal will convey to the machine operator the position of the joint end of the spreading element with respect to the edge line 16 as previously described.

For example, the visual display may be a simple set of lamps or LED's, a center one, (when energized) indicating that the joint end of the spreading element is at the preselected desired position with respect to the reference or edge line; a right one (when energized) indicating that the joint end of the spreading element is displaced inwardly of the desired reference or edge line, and a left one (when energized) indicating that the joint end of the spreading element is displaced outwardly of the desired reference or edge line. The lamps may be arranged and constructed to be selectively energized such that when a given display device is ON, the joint end of the spreader element is shown to be inboard of the edge line 16 thereby indicating to the operator that the joint end of the spreading element is to be moved outward in order to bring it back into proper relationship. Similarly, when another display device is ON, the joint end of the spreading element is shown to be outward of the edge line 16 thereby indicating to the operator that the joint end of the spreading element is to be moved inward to bring it back into proper relationship. Similarly, when the center display device is ON, the joint end of the spreading element is in the desired neutral position indicating that the spreading element is at the preselected desired relationship to the reference or edge.

When an inward or outward indicating display device is ON, the operator may then either steer the paver machine, or operate the electrical finger tip control switches provided on the consoles of the standard paver machine to effect the desired movement of the extendible screed section 38 to bring the joint end of such spreading element into the desired alignment with the edge line 16 of the cold mat to thereby assure that the joint edge of the second mat section of fresh, hot paving material will be properly positioned with respect to the edge line.

Preferably, in accordance with one embodiment of the invention the joint end of the spreading element is positioned so that the joint edge of the fresh paving material is placed parallel to, and contiguous with, the edge line 16 and without any overlap or gap. The operator may steer the entire paver machine to reposition it with respect to the edge line 16, or the operator can reposition the joint end of the extendible screed section to accomplish the same result.

As shown in FIG. 2 the edge line sensing means 42 is mounted to the paver machine by means of a suitable bracket 44 so as to move across the edge region 14 as the paver machine moves alongside the cold mat 10. Conveniently, the sensing means 42 is mounted from the extendible screed extension 38, as illustrated. The sensing means 42 is arranged and constructed to provide a signal representative of the location of the edge line 16. The signal from edge line sensing means 42 is suitably processed in any well known manner to provide a control signal indicative of the position of the joint end of the main screed section (or the joint end of the extendible screed section 38) with respect to the edge line 16. The control signal is applied to a suitable conventional electrical and/or electro- hydraulic control means which causes appropriate movement of hydraulic cylinders connected with the extendible screed sections 38 to cause the joint end of the extendible screed section 38 to be brought into proper alignment with the edge line 16 and assure that the joint edge of the second mat section of fresh paving material is placed in the desired location with respect to the edge line 16. Alternatively, the paver machine may be automatically steered, such as by the use of variable speed electrical motors, or a suitable arrangement of hydraulic power cylinders as is well known in the art.

Referring now to FIG. 3 wherein there is illustrated a simplified schematic electrical block diagram for sensing and controlling a lateral deviation of the joint end of the paver spreading element from a desired reference in accordance with this invention. As previously stated, although the sensing means 42 may be of any suitable type, it is illustrated in FIG. 3 as being of the preferred, non-contacting capacitance type.

The conventional use of a capacitance type sensing system is to determine displacement. That is, the distance between two conductive objects. Assuming that the dielectric constant does not change as the distance between the two capacitor plates changes, the capacitance will change. This change can be measured and calibrated for distance in well known manner. However, if the distance between the capacitor plates is kept constant, and there is a change in the dielectric constant, then the capacitance will change. This capacitance type sensing means is employed in this manner with the present invention and is effective to measure the density of the paving material and/or the mass of such paving material. Accordingly, instead of being a displacement measuring system, it becomes a mass sensing system. It is this mode of operation of the capacitance sensing means which is employed with the present invention to provide for the sensing of the edge line of the cold mat section and the sensing of the center of mass of the paving material of the edge region.

As shown in FIG. 3 the edge sensing system includes the sensing means 42 and a control box 60. The capacitance sensing means 42 includes at least two laterally spaced apart capacitance proximity sensors 50 and 52 connected to sensing plates 54 and 55 respectively. Sensors 50 and 52 may be of any suitable type. Preferably, sensors 50 and 52 are capacitance proximity switches, such as Model PC- 131, manufactured and sold by Gordon Products, Inc., 67 Del Mar Drive, Brookfield, Conn. 06804. Such sensors are unaffected by temperature, humidity, light, dirt, or other normal conditions encountered in road construction.

The capacitance proximity switches 50 and 52 are arranged so as to have a settable threshold to air. The areas of the sensor plates 54 and 55 are arranged and constructed to provide for a determination of how much or how little material is to be disposed under the sensor plate before such sensor is considered to be "off" the material, and the system is calibrated accordingly.

The system also includes the control box 60 which includes a logic and timing means 62, a visual display means 64, which may be a plurality of lamps, light emitting diodes (LED), or other display devices, and a suitable control means 66, shown as including two control relays 68 and 70.

The control relays 68 and 70 are arranged so that when such control relay is energized, it causes energization of a given hydraulic solenoid of the paver machine to cause movement of the extendible screed section 38 in an inward, or "in" direction or an outward "out" direction, respectively. That is, energization of relay 68 may be arranged to cause movement of extendible screed section 38 in one direction and energization of relay 70 may be arranged to cause movement of the extendible screed section 38 in the opposite direction. That is, energization of a control relay 68 or 70 produces a desired lateral movement of the extendible screed section 38.

The outputs of proximity sensors 50 and 52 are fed to the logic and timing means 62 of control box 60. The timing portion of means 62 can be of any well known type which operates to send out fixed duration pulses plus a "time delay" pulse. The time delay pulse is operative to inhibit the sending of another pulse for a specified period of time. For example, in a suitable arrangement the time delay may be in the range of about 10 ms. to 1 second.

In operation, when one of the capacitance proximity sensors 50 or 52 is "on" the paving material and the other sensor is "off" the paving material, neither control relay 68 or 70 will be energized and the joint end of the extendible screed section 38 is determined to be in the desired location. This is the neutral position and the system is initially calibrated so that at this condition (one sensor "on" and one sensor "off" the paving material) the joint end of the extendible screed section 38 is at the predetermined desired position with respect to the edge line.

When the sensors 50 or 52 are both over or "on" the paving material , the logic portion of means 62 is arranged and constructed to cause energization of a selected control relay which in turn causes energization of one of the hydraulic cylinders of the paver machine to cause movement of the extendible screed section 38, or to control the steering of the paver, as the case may be. For example, for a given arrangement this condition could result in energization of the control relay 68 to cause energization of the appropriate hydraulic cylinder of the paving machine to cause the extendible screed section 38 to move in the inward or "in" direction. This control relay and the associated hydraulic cylinder will remain energized to cause continued inward movement of the screed section 38 so long as this condition exists. That is, so long as both capacitance proximity sensors 50 and 52 are over or "on" the paving material.

On the other hand, when both sensors 50 and 52 are "off" the paving material, the control relay 70 is energized to cause energization of the other hydraulic solenoid of the paving machine to cause movement of the extendible screed section 38 in the outward or "out" direction.

As stated, the system is initially calibrated or "set-up" so that the neutral position (neither control relay 68 or 70 energized) represents the condition when one sensor, for example sensor 50 is "on", or over, the paving material and the other sensor 52 is "off" ,or not over, the paving material. This will be the desired (neutral) position of the joint end of the extendible screed section 38. Deviation to the right or left of this neutral position will cause selective energization of the control relays 68 or 70 to cause the appropriate movement of the extendible screed section 38 in or out to return it to this neutral position.

The system may also be provided with a fail-safe means to prevent energization of the control relays 68 and 70 whenever the signal from sensors 50 or 52 call for movement in the same direction (in or out) for more than a predetermined continuous period of time, which may be, for example, a period of more than 1 second.

Referring now to FIG. 4 wherein there is illustrated a simplified schematic/hydraulic block diagram showing an arrangement which is suitable for controlling a lateral deviation of the joint end of the paver machine spreading element (e.g. extendible screed section) from a desired edge line or other reference in accordance with this invention. As previously stated, although the sensing system 42 may be of any suitable type, it is illustrated again in FIG. 4 as being of the preferred capacitance type.

As illustrated, the capacitance sensing system 42 is as already described in connection with FIG. 3. For example, the sensing system 42 includes a plurality of capacitance proximity sensors 50 and 52 connected in laterally spaced-apart relationship to the sensing plates 54 and 55, as described in connection with FIG. 3.

In the arrangement of FIG. 4, the control box 60 is symbolized in a very simple and schematic manner as a movable switch arm 80 having a center neutral position to represent when the joint end of the screed section 38 is in the desired neutral position. That is, a center position representing the neutral position, and right and left contact positions representing right and left switch arm movement conditions.

The arrangement of FIG. 4 is shown as including a magnetic, or solenoid type control valve 82 connected to the cylinder of a hydraulic power cylinder arrangement 40 by the hydraulic conduits 84 and 85. The magnetic control valve 82 is actuated by solenoids 86 and 88 depending upon whether the switch arm 80 is in contact with the left contact 90 or the right contact 92 for closing respective electrical circuit means 94 and 96 to energize either solenoid 86 or solenoid 88 through the source of electrical energy, shown as the battery 98. Spring means 100 and 102 are provided for returning the valves to the neutral positions. Hydraulic power is supplied to the power piston arrangement 40 through magnetic control valve 82 through conduits 84 and 85 from a suitable pump 106 which draws hydraulic fluid from a sump 108 to which such fluid is returned through conduit 110.

In operation, when the sensing system 42 indicates that the joint end of the extendible screed section 38 is to the right of the desired (neutral) position, the switch arm 80 is moved to the right and onto contact 92 thereby closing the electric circuit 96 and energizing the solenoid 88 to supply hydraulic fluid through the magnetic control valve 82 in a direction to move the piston of the hydraulic power piston arrangement to the left to bring the joint end of the extendible screed section 38 back to the desired neutral position. Similarly, when the sensing system 42 indicates that the joint end of the extendible screed section 38 is to the left of the desired neutral position, the switch arm 80 is moved to the left and onto contact 90 thereby closing the electrical circuit 94 and energizing the solenoid 86 to supply hydraulic fluid through the magnetic control valve 82 in a direction to move the piston of the hydraulic power piston arrangement 40 to the right to bring the joint end of the extendible screed section 38 back to the desired neutral position. The desired neutral position may be the actual edge line, or a position displaced a predetermined distance from such edge line, such as when desired to provide for a desired overlap when employing an overlap type paving technique, for example.

While there have been described what are at present considered to be the preferred embodiments of this invention, many changes and modifications not departing from the invention will occur to those skilled in the art. It is, therefore, intended in the appended claims to cover all such changes and modifications which come within the true spirit and scope of the invention.

What is claimed is:

1. The method of forming an improved longitudinal paving joint between first and second mat sections of paving material, comprising:

laying a first mat section of paving material on a selected substrate, said first mat section having an inboard edge;

compacting the paving material of said first mat section to achieve a predetermined density in said first mat section, said compacting resulting also in the squeezing of the unsupported inboard edge of the first mat section to form an edge region which angles downward from an edge line at the top inboard edge of the compacted first mat section to said substrate;

continuously sensing and determining the location of the edge line of said compacted first mat section, and laying a second mat section of fresh paving material and laterally controlling the laying thereof in accordance with said sensing and determination so that the inboard edge of said second mat section of fresh paving material is laid at a selected location with respect to the edge line of said compacted first mat section.

2. The method recited in claim 1 wherein the determination of the location of the edge line of said compacted first mat section of paving material includes determining the center of mass of said inboard edge region.

3. The method recited in claim 1 wherein said inboard edge region slopes downward from said edge line and said method further includes forming near said sloping inboard edge region a shaped charge region having a predetermined profile and containing a predetermined quantity of additional fresh paving material whereby when said second mat section is rolled, fresh paving material of the shaped charge region is forced into said inboard edge region and the material of said inboard edge region is also heated thereby to provide a high density substantially fused longitudinal joint between said first and second mat sections.

4. The method recited in claim 3 including forming said shaped charge region with a profile which terminates at one end near said inboard edge region of said second mat section and extends in a direction toward the center of said second mat section at an angle less than 90 degrees to a summit and angles downward from said summit to a blending point with the surface of said second mat section, and wherein said summit is biased in the direction of said inboard edge.

5. A system for producing an improved longitudinal paving joint between an edge line of a first cold mat section of paving material which has been laid and previously compacted on a selected substrate, and the joint edge of a second mat section of fresh paving material to be laid on said substrate by a spreading element of a paver machine moving longitudinally with respect to the first cold mat section, and wherein said first cold mat section includes an edge region extending downward from the edge line of said edge region to said substrate, comprising:

sensing means carried by said paver machine and arranged and constructed for disposition proximate said edge region for generating an electrical signal representative of the location of the edge line of said first cold mat section;

electrical circuit processing means responsive to the electrical signal from said sensing means for producing a control signal representative of the lateral position of a selected end of the spreading element of the paver machine with respect to said edge line, and control means responsive to said control signal for causing lateral movement of said spreading element so as to position the joint end of said spreading element with respect to the edge line of said first cold mat section to cause the joint edge of the second mat section of fresh paving material to be laid at a selected location with respect to the edge line of said first cold mat section.

6. The system recited in claim 5 wherein said edge region extends substantially vertically downward from the edge line of said edge region to said substrate.

7. The system recited in claim 5 wherein said edge region extends at a sloping downward angle from the edge line of said edge region to said substrate.

8. The system recited in claim 5 wherein said spreading element of said paver machine is arranged and constructed to lay a shaped charge region containing a predetermined quantity of fresh paving material along the top surface of said second mat section and which shaped charge region has a profile which terminates at one end near the joint edge of said second mat section and extends in a direction toward the center of said second mat section at an angle less than 90 degrees to a summit and angles downward from said summit to a blending point with the surface of said second mat section, and wherein said summit is biased in the direction of said joint edge of said second mat section.

9. The system recited in claim 8 wherein said control means causes lateral movement of the selected end of said spreading element by control of the steering said paver machine.

10. The system recited in claim 8 wherein the spreading element of the paver machine is a power extendible screed section and said control means causes lateral movement of said power extendible screed section.

11. The system recited in claim 5 wherein said sensing means includes a plurality of laterally spaced-apart capacitance proximity sensors arranged and constructed for lateral movement across and out of contact with the surface of said edge region.

12. The system recited in claim 11 wherein said sensing means is arranged and constructed to determine the center of mass of said edge region.

13. The method of making an improved longitudinal paving joint between at least one edge line of a pavement structure and the joint edge of fresh paving material, comprising:

continuously sensing and determining the location of an edge line of said pavement structure, wherein the edge line of said pavement structure comprises the downwardly sloping edge region of a previously rolled and compacted mat of paving material, and controlling the laying of fresh paving material in accordance with said determination so that said joint edge of fresh paving material is laid at a selected location with respect to said edge line of said pavement structure.

14. The method of making an improved longitudinal paving joint between at least one edge line of a pavement structure and the joint edge of fresh paving material, comprising:

continuously sensing and determining the location of an edge line of said pavement structure, wherein the edge line of said pavement structure comprises one or both of the edges of a trench previously cut into said pavement structure, the location of which edge lines are continuously sensed and determined, and controlling the laying of fresh paving material in accordance with said determination so that said joint edge of fresh paving material is laid at a selected location with respect to said edge line of said pavement structure.

* * * * *